US007453194B1

(12) United States Patent
Gibboney

(10) Patent No.: US 7,453,194 B1
(45) Date of Patent: Nov. 18, 2008

(54) MECHANICAL SHUNT FOR USE IN THE SOCKETS OF A STRING OF LIGHTS

(76) Inventor: James W. Gibboney, 3910 Dial Mill Rd., Conyers, GA (US) 30208

( * ) Notice: Subject to any disclaimer, the term of this patent is extended or adjusted under 35 U.S.C. 154(b) by 0 days.

(21) Appl. No.: 12/133,800

(22) Filed: Jun. 5, 2008

(51) Int. Cl.
*H01J 5/48* (2006.01)

(52) U.S. Cl. ..... 313/318.1; 313/318.09

(58) Field of Classification Search ..... 313/318.01, 313/318.03, 318.05, 318.09, 318.1; 362/226, 362/653, 658; 439/619
See application file for complete search history.

(56) References Cited

U.S. PATENT DOCUMENTS

| | | | |
|---|---|---|---|
| 1,314,008 | A | 8/1919 | McWilliams |
| 1,536,322 | A | 5/1925 | Dam |
| 2,050,364 | A | 8/1936 | Morton |
| 2,484,596 | A | 10/1949 | Waltz |
| 2,984,813 | A | 5/1961 | Bossi |
| 3,286,088 | A | 11/1966 | Ahroni |
| 3,522,579 | A | 8/1970 | Matsuya |
| 3,783,437 | A | 1/1974 | Graff et al. |
| 4,340,841 | A | 7/1982 | Schupp |
| 4,808,885 | A | 2/1989 | Bauch et al. |
| 4,870,547 | A | 9/1989 | Crucefix |
| 5,139,343 | A | 8/1992 | Lin |
| 5,281,158 | A | 1/1994 | Lin |
| 5,453,664 | A | 9/1995 | Harris |
| 5,707,138 | A | 1/1998 | Pan |
| 5,791,940 | A | 8/1998 | Chen et al. |
| 5,800,047 | A | 9/1998 | Yang |
| 5,829,865 | A | 11/1998 | Ahroni |
| 5,852,348 | A | 12/1998 | Lin |
| 6,043,593 | A | 3/2000 | Pan |
| 6,053,774 | A | 4/2000 | Lin |
| 6,113,430 | A | 9/2000 | Wu |
| 6,217,191 | B1 | 4/2001 | Wu et al. |
| 6,257,740 | B1 | 7/2001 | Gibboney, Jr. |
| 6,283,797 | B1 | 9/2001 | Wu |
| 6,347,965 | B1 | 2/2002 | Pan |
| 6,361,368 | B1 | 3/2002 | Tseng |
| 6,533,437 | B1 | 3/2003 | Ahroni |
| 6,609,814 | B2 | 8/2003 | Ahroni |
| 6,650,065 | B1 | 11/2003 | Sheih |
| 6,774,549 | B2 | 8/2004 | Tsai et al. |
| 6,805,463 | B2 | 10/2004 | Shieh |
| 6,857,905 | B2 | 2/2005 | Sheih |
| 7,253,556 | B1 | 8/2007 | Gibboney et al. |
| 7,264,392 | B2 | 9/2007 | Massabki et al. |
| 2002/0118540 | A1 | 8/2002 | Ingrassia |
| 2003/0142494 | A1 | 7/2003 | Ahroni |
| 2003/0209981 | A1 | 11/2003 | Gibboney, Jr. |
| 2003/0218412 | A1 | 11/2003 | Sheih |
| 2006/0274556 | A1 | 12/2006 | Massabki et al. |
| 2007/0274073 | A1 | 11/2007 | Prineppi |

*Primary Examiner*—Peter Macchiarolo
(74) *Attorney, Agent, or Firm*—Michael A. Mann; Nexsen Pruet, LLC

(57) ABSTRACT

A mechanical shunt for use in a socket of a string of lights resides in an otherwise typical lamp of a string of lights. The present shunt is generally T-shaped spring shunt with lateral ends with curved portions. The shunt is held by a shunt holder between the two conducting electrical terminals on the wall of the socket. Its curved portions contact the terminals when the base is removed but is electrically and physically separated from the terminals by the depending flanges of the base when the base is inserted.

7 Claims, 4 Drawing Sheets

MECHANICAL SHUNT FOR USE IN THE SOCKETS OF A STRING OF LIGHTS

CROSS REFERENCE TO RELATED PATENTS

This application is related to commonly owned U.S. Pat. No. 7,253,556, issued Aug. 7, 2007.

BACKGROUND OF THE INVENTION

The present invention relates to light strings such as are used for holiday lighting.

Strings of lights are typically wired electrically in series. Consequently, when one light in the string burns out or is removed, all the lights in the string go out. Determining which light has burned out is tedious. Although finding a missing bulb in a string of lights is a little easier, even if the string has 50 lights, it can still be quite a task when the string of lights is attached to a Christmas tree.

For a number of years, this problem has been solved, or at least avoided, by the use of shunts that allow current to pass directly between the terminals of the defective lamp, bypassing the missing or defective bulb filament. Passing the electrical current from one lamp to the next regardless of the condition of the bulb in any individual lamp allows the remaining lamps to continue to operate.

Shunts are typically found in two places in prior art lamps, namely, in the glass globe and in the socket. The shunts inside the glass globe are typically coils of wire wrapped around the conductive elements (called Dumet wires). When the filament fails, the oxide coating on the wires that theretofore prevented direct conduction of electricity is burned off and the coil welds itself to the Dumet wires, thereby providing a new electrically conductive path for passing the electrical current.

Of the two types of shunts that are located in the socket, there are also two types, namely, solid state and mechanical shunts. Among the mechanical shunts, for example, there is a set of spring contact terminals that is the subject of U.S. Pat. No. 6,257,740. These spring contacts are pushed apart when the lamp base is inserted into the socket and spring back together when the base is removed, thereby allowing the current to pass from one terminal to the other directly. This type is strictly for use when the bulb (and its base) is removed and does not address the issue of a burned out bulb. This type of shunt works well and has enjoyed commercial success.

Another mechanical shunt is disclosed in U.S. Pat. No. 7,253,556, which is invented by the present inventor and is commonly owned. This mechanical shunt is a generally horizontal flat strip of metal held in place between the two electrical terminals in a light socket by a shunt holder. The lateral ends of the shunt extend laterally to engage the electrical terminals on the socket wall. When the lamp base, which is hollow, is inserted into the socket, the shunt holder with its shunt is received inside the hollow base, and, as the shunt enters the base, its lateral ends are bent down and away from the electrical terminals, thereby allowing electrical current to pass to and through the Dumet wires and thence to the filament in the bulb rather than directly through the shunt.

There are a huge number of light strings manufactured and sold each year throughout the world. The number is so large that even small changes that, for example, reduce material requirements, simplify manufacturing, or improve safety or reliability, make a huge difference in the costs to manufacture. Accordingly, there remains a need for a better mechanical shunt for use in the sockets of the lamps of light strings.

SUMMARY OF THE INVENTION

According to its major aspects and briefly recited, the present invention is a mechanical shunt for use in a socket of a lamp in an electrical series of lights such as a holiday light string. A string of lights has plural lamps interconnected in an electrical series by conductive insulated wires. Each lamp includes a globe that houses a pair of Dumet wires with a filament running between them. The Dumet wires extend from the inside the globe outside it and into holes formed in a base. The base is insertable into a socket which has two electrical terminals affixed to the interior surface of its wall, each terminal being to one of the electrically conducting wire entering the bottom of the socket from the next lamps in the string. The base has two downwardly depending flanges with slits formed therein. The Dumet wires emerge from the holes in the base between the depending flanges and are then passed through the slits to the outside of the base. Once through the slits, the Dumet wires are folded up against the outside of the base where, when the base is inserted into the socket, they will engage the electrical teminals on the socket wall.

The present shunt is a T-shaped spring, preferably a single piece of resilient metal folded in half and then folded at roughly a 90° angle near each end to form a T. Then its lateral ends are curved down and slightly inward toward the center fold to define curved portions. The folded center of the shunt spring is held in position in a slot in a shunt holder and the holder itself is positioned in the bottom of the socket so that the curved portions of the lateral ends engage the electrical terminals on the socket wall. When the base is inserted into the socket, the depending flanges of the base cam the curved lateral ends of the spring inward, away from the terminals so that the conductive path runs through the Dumet wires and the filament in the globe rather than through the shunt. When the base is removed, the curved lateral ends of the spring shunt resiliently spring apart and back into engagement with the terminals.

An important advantage of the present invention is that it saves small amounts of material in the base and the shunt and its holder are more easily manufactured and assembled than prior art mechanical shunts. Given the huge volumes of lamps manufactured every year, individual small savings constitute collectively a significant improvement.

An important feature of the present invention is the shape of the shunt. The center fold makes it easier to install into the slot of the shunt holder and that slot does not have to meet fine tolerances. The depending flanges of the base more easily cam the curved portions of the lateral ends more easily and more repeatably.

Still another feature of the present invention is the depending flanges of the base. These opposing flanges require less material than the hollow, box-like shape of the base disclosed in U.S. Pat. No. 7,523,556. Furthermore, they perform the same three functions, namely, moving the curved lateral ends of the shunt away from the electrical terminals, isolating the shunt electrically from the terminals, and centering the Dumet wires on the terminals.

These and other features and their advantages will be apparent to those skilled in the art of light string electrical design from a careful reading of the Detailed Description of Preferred Embodiments accompanied by the following drawings.

DETAILED DESCRIPTION OF THE INVENTION

The present invention is a lamp with a mechanical shunt for use in a socket of a lamp that is part of a string of lights in which the lights of the string are arranged electrically in series. It is also a method for making a mechanical shunt for a lamp that is part of a light string.

The term light string refers to plural spaced-apart lamps interconnected in an electrical series by electrical wiring. The term lamp refers to the whole of a bulb in a base inserted into a socket. The bulb is a partially evacuated transparent globe with electrically conducting Dumet wires extending from inside of it to its exterior and with a coiled wire filament between the ends of the Dumet wires inside the globe. The base holds the bulb and brings them into engagement with the electrical terminals mounted to the interior walls inside the socket when the base is in the socket.

The present invention is an improvement to prior art mechanical shunts and is in particular and improvement to that described in U.S. Pat. No. 7,253,556, which is incorporated herein by reference.

Figure 1:
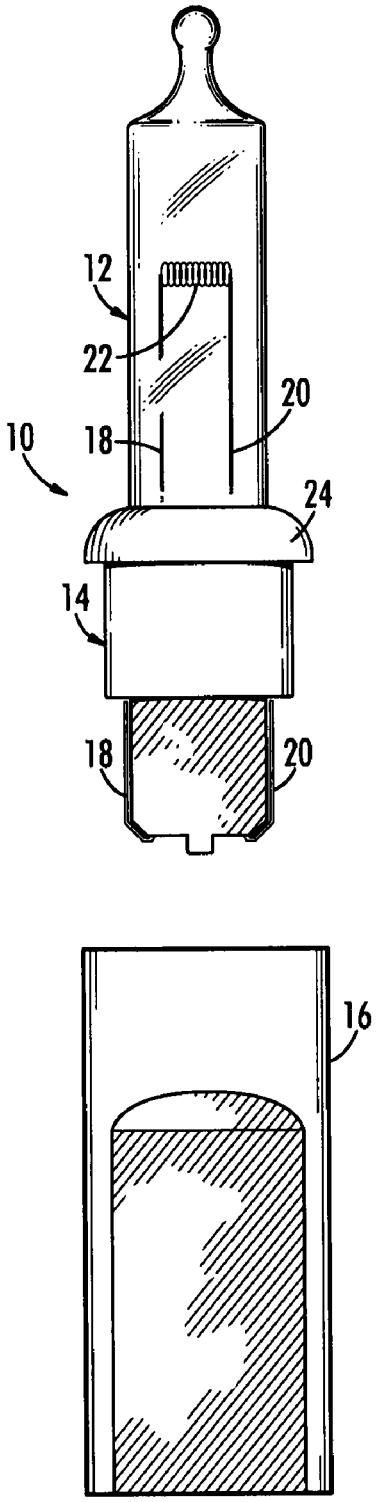
FIG.1 PRIOR ART
FIG. 1 is side view of a prior art lamp for use in a string of lights with the lamp base pulled from the socket.

FIG. 1 illustrates a prior art lamp 10 for use in a string of lights, shown with the globe 12 and its base 14. Base 14 is removable from the lamp socket 16, and, indeed, in FIG. 1 is shown removed from socket 16. Two Dumet wires 18, 20 are visible running on opposing sides of base 14 and inside globe 12. Dumet wires 18, 20, hold a filament 22. There is thus defined an electrical path from Dumet wire 18 to filament 22 and thence to Dumet wire 20; an electrical current flowing through this path will cause filament 22 to incandesce. Base 14 fits snuggly into socket 16 when base 14 is pushed into socket 46 until a seating flange 24 limits further insertion.

Figure 2:
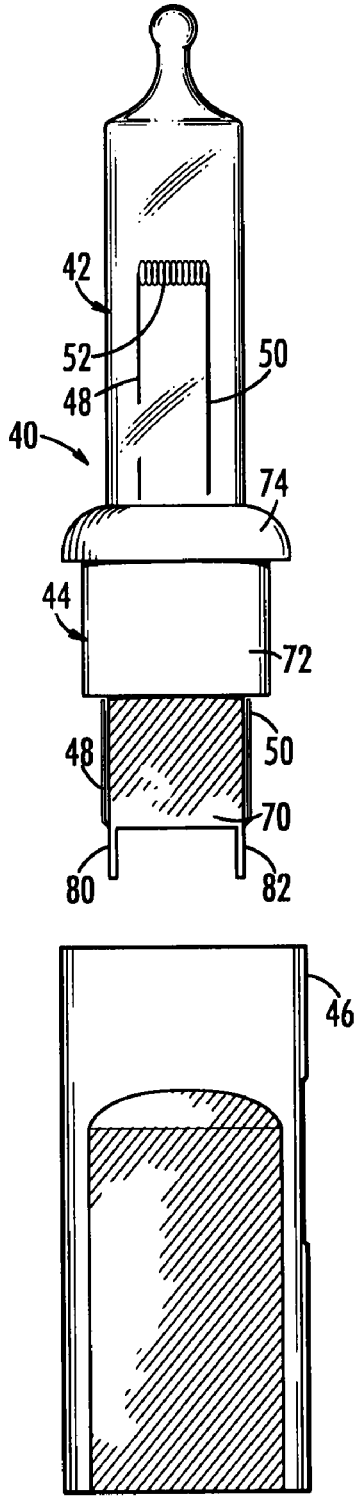
FIG. 2 is side view of a lamp with a mechanical shunt, according to a preferred embodiment of the present invention, also with the lamp base pulled from the socket.
Figure 4:
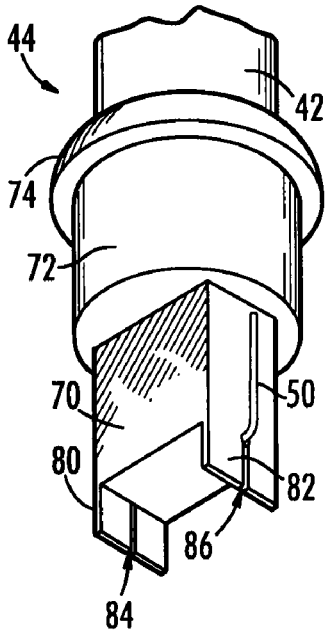
FIG. 4 is a perspective view of the base of the lamp of FIG. 2 from the bottom right, according to a preferred embodiment of the present invention.

FIG. 2 is very similar to FIG. 1. It, too, shows a lamp 40 with a globe 42 carried by a base 44 that is insertable into a socket 46. Two Dumet wires, 48, 50, extend from outside base 44, through base 44 into globe 42 to filament 52, thus defining an electrical path from first Dumet wire 48 to filament 52 and thence to second Dumet wire 50. Note, too, the differences between FIG. 1 and FIG. 2. Base 44 has an upper portion 72 and a seating flange 74 that are similar to those of lamp 10 but a lower portion 70 that is different, namely, it has two downwardly depending flanges 80, 82. Flanges 80, 82, have slits 84, 86 formed therein (best seen in FIG. 4) through which Dumet wires 48, 50 pass to the outsides of base 44 where they are bent upwards, and which slits 84, 86 serve to hold Dumet wires 48, 50 in place for engagement with the electrical terminals mounted to the interior surface of the wall of socket 46.

Figure 3A:
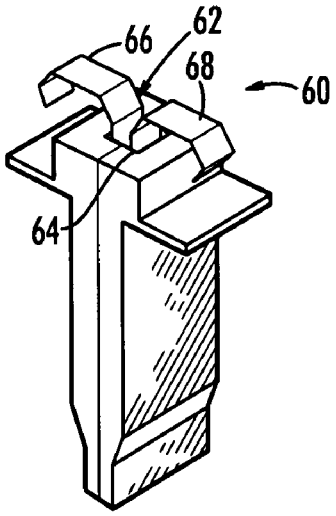
FIG. 3A is a perspective view of the shunt holder of the lamp of FIG. 2 with the shunt viewable from the top right, according to a preferred embodiment of the present invention.

Referring now to FIG. 3A illustrates a shunt holder 60 with a shunt 62 in a slot 64. Shunt 62 is a thin, flat or round conductive wire that is somewhat "T"-shaped. Shunt 62 is formed by folding the center of a thin strip or wire of resilient conductor material in half to forma a narrow V and then folding its two halves outward to form the T shape and thus defining outwardly extending lateral ends 66, 68. Edges 66, 68 are preferably bent to curl them downward and slightly inward. The middle portion of shunt 62, where it is folded into the narrow V shape, is inserted into slot 64 and secured in place, preferably by its own resiliency and friction. Slot 64 is wide enough at the top so that shunt 62's lateral ends 66, 68, separate at the center fold, urged by the resiliency of the metal of which shunt 62 is made. Slot 64 is just deep enough to accommodate shunt 62 and hold it; if shunt 62 is a wire, slot 64 is narrower so that shunt 62 is held in position front to back; if shunt 62 is a flat spring, then slot 64 is a little wider front to back than shunt 62.

Figure 3B:
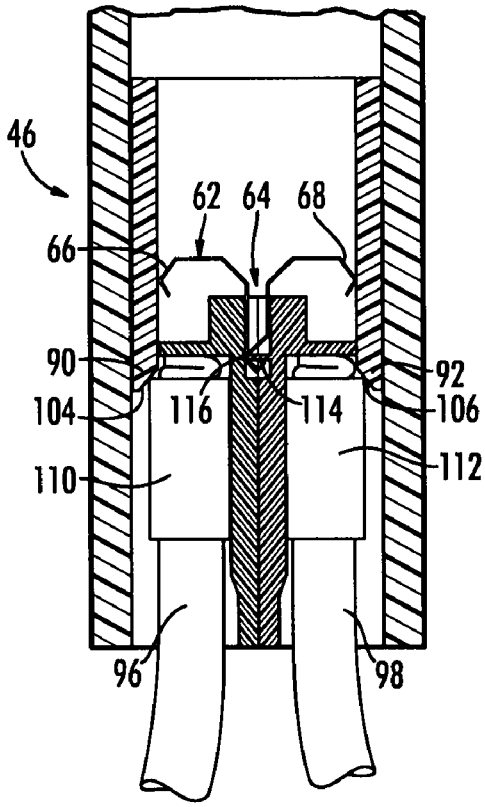
FIG. 3B is a detailed cross sectional view of the shunt holder of FIG. 3A, according to a preferred embodiment of the present invention.

As illustrated in FIG. 3B, shunt holder 60 is made in two halves 110, 112, that are connected along one side. One half is molded with a projecting pin 114; the other half with a small hole 116 so that, when spring shunt 62 is inserted into the slot 64 formed when the two halves of holder 60 are brought together, the projecting pin deforms spring shunt 62 against hole so as to help hold it in place in slot 64.

Figure 5:
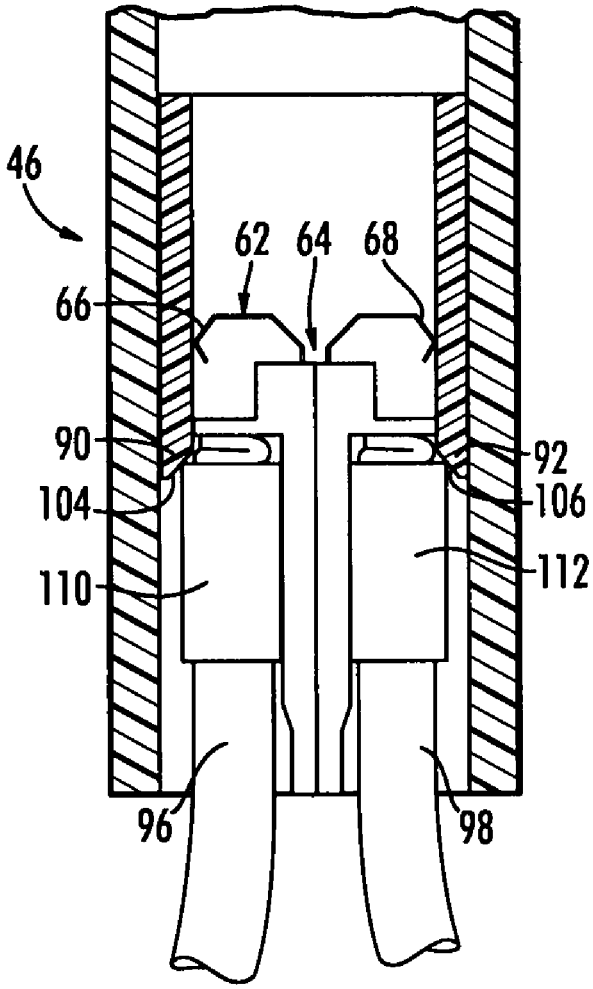
FIG. 5 is a side, cross-sectional view of a portion of the lamp of FIG. 2, according to a preferred embodiment of the present invention, with the base fully removed so that the shunt conducts electricity between the electrical terminals on the socket wall.
Figure 6:
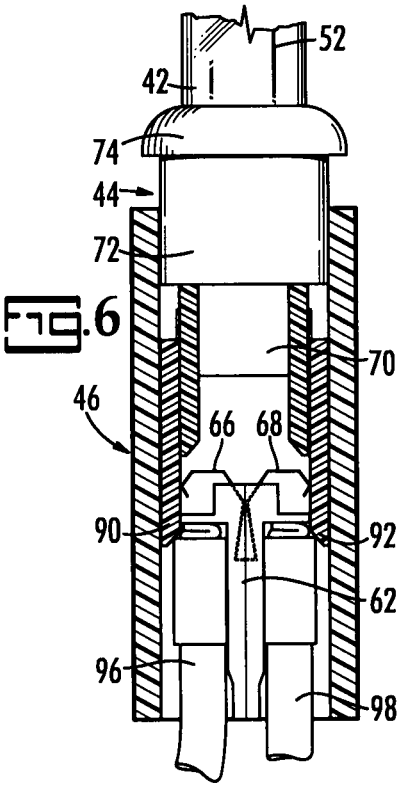
FIG. 6 is a side, cross-sectional view of a portion of the lamp of FIG. 2, according to a preferred embodiment of the present invention, with the base partially inserted to the point where it is about to deactivate the shunt.
Figure 7:
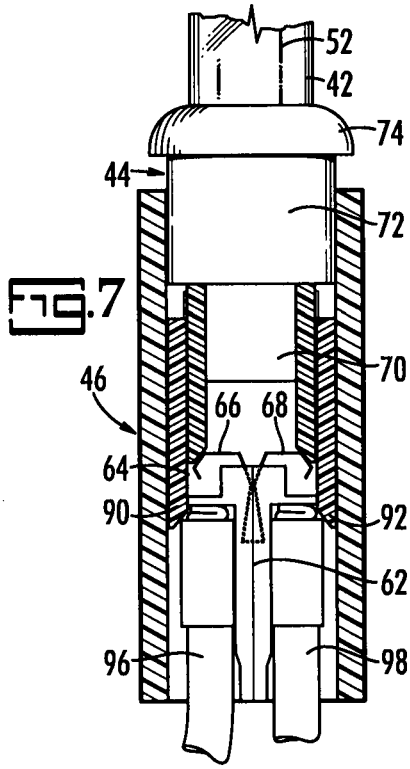
FIG. 7 is a side, cross-sectional view of a portion of the lamp of FIG. 2, according to a preferred embodiment of the present invention, with the base inserted just far enough to deactivate the shunt.
Figure 8:
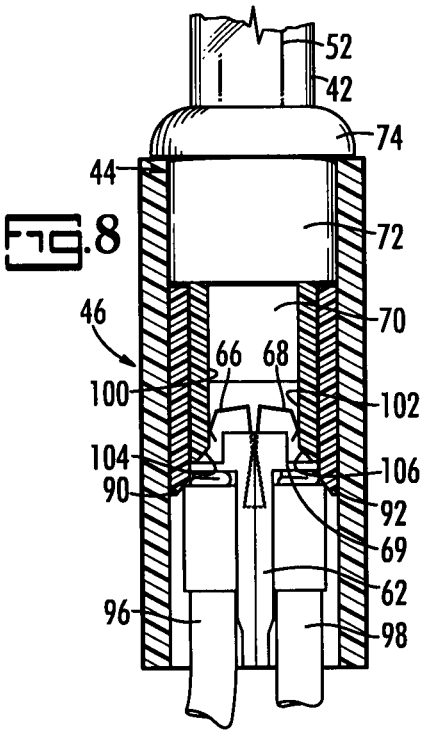
FIG. 8 is a side, cross-sectional view of a portion of the lamp of FIG. 2, according to a preferred embodiment of the present invention, with the base fully inserted.

FIGS. 5, 6, 7 and 8 illustrate the operation of the present mechanical shunt. FIG. 5 is a side, cross-sectional view illustrating socket 46 with base 44 completely removed. Each of FIGS. 6-8 is also a side, cross-sectional view of the same lamp 40 (with only a small part of globe 42 showing) but with base 44 shown partially withdrawn from socket 46 in FIG. 6, partially inserted in FIG. 7, and fully seated in FIG. 8. Socket 46 has two conductive terminals 90 and 92 carried by the interior surface of the wall of socket 46. Terminals 90, 92, are in electrical connection with a pair of electrical wires 96, 98 entering the bottom of socket 46. Wire 96 leads to a previous light, and wire 98 leads to the next light in the string of lights. Shunt holder 60 serves to separate and electrically isolate the bare (uninsulated) portions of wires 96, 98 and their respective connections to electrical terminals 90, 92.

As base 44 is progressively inserted deeper into socket 46 (compare FIGS. 6, 7, and 8), the lower portion of base 70, and in particular, flanges 80, 82, interact with the curved lateral ends 66, 68, of shunt 62, forcing curved lateral ends 66, 68, to curl inwardly away from the electrical terminals 90, 92, respectively, as flanges 80, 82, interpose themselves between edges 66, 68, and terminals 90, 92, thereby electrically isolating edges 66, 68, from terminals 90, 92. Flanges 80, 82, preferably have beveled edges 104, 106, to facilitate this interposition. Importantly, the timing of the separation of lateral ends 66, 68 from terminals 90, 92, and the breaking of physical and electrical contact follows the establishment of contact between terminals 90, 92 and Dumet wires 48, 50, so that no arcing takes place between edges 66, 68, and terminals 90,92, once they are physically separated. Similarly, the withdrawal of base 44 allows lateral ends 66, 68 to regain contact with terminals 90, 92 before they lose contact with Dumet wires 48, 50, for the same reason.

It is intended that the scope of the present invention include all modifications that incorporate its principal design features, and that the scope and limitations of the present invention are to be determined by the scope of the appended claims and their equivalents. It also should be understood, therefore, that the inventive concepts herein described are interchangeable and/or they can be used together in still other permutations of the present invention, and that other modifications and substitutions will be apparent to those skilled in the art from the foregoing description of the preferred embodiments without departing from the spirit or scope of the present invention.

What is claimed is:

1. A lamp for use in a light string, said lamp comprising:

a globe;

a filament in said globe;

a base carrying said globe, said base having a pair of holes formed therein; a first and an opposing second Dumet wire extending from inside said globe through said holes in said base, and wherein said base has two opposing depending flanges;

a socket carrying said base, said base removably seatable in said socket, said socket having an interior wall;

a first and an opposing second electrical terminal carried by said interior wall of said socket, said first and said second Dumet wires engaging said first and said second electrical terminals, respectively, when said base is seated in said socket;

a shunt holder carried by said socket between said first and said second electrical terminals and having a slot formed therein; and a conductive spring shunt being inserted into said slot of said shunt holder and having two opposing lateral ends extending laterally of said shunt holder and having curved portions, said curved portions of said lateral ends being in contact with said first and second terminals of said socket when said base is not inserted in said socket but being urged away from said first and said second terminals when said base is inserted into said socket, wherein said depending flanges have slits formed therein for said Dumet wires to pass through from between said depending flanges to outside said depending flanges.

2. The lamp as recited in claim 1, wherein said Dumet wires exit said holes in said base between said depending flanges.

3. The lamp as recited in claim 1, further comprising a first and an opposing second electrical wires in electrical connection with said first and second electrical terminals, respectively, so that an electrical path exists, when said base is in said socket, from said first electrical wire to said first electrical terminal to said first Dumet wire to said filament to said second Dumet wire to said second electrical terminal to said second electrical wire, and wherein said shunt holder is formed to isolate electrically said first and second electrical wires from said shunt.

4. The lamp as recited in claim 1, wherein said shunt is made of a resilient electrical conductor folded and inserted in said slot of said shunt holder.

5. The lamp as recited in claim 1, wherein said depending flanges and said electrical terminals are dimensioned so that, when said base is removed from said socket, said curved portions of said first and second lateral ends of said shunt engage said first and second electrical terminals before said first and second Dumet wires disengage said first and second electrical terminals.

6. The lamp as recited in claim 1, wherein said depending flanges and said electrical terminals are dimensioned so that, when said base is inserted into said socket, said first and second Dumet wires engage said first and second electrical terminals before said curved portions of said first and second lateral ends of said shunt disengage from said first and second electrical terminals.

7. The lamp as recited in claim 1, wherein said shunt holder is formed in two parts with a pin formed on a first part and a hole formed on a second part, said hole being in registration with said pin so that, when said shunt is inserted into said slot of said shunt holder, said pin secures said shunt in place between said first and said second parts of said shunt holder.

* * * * *